United States Patent [19]

Kuipers

[11] Patent Number: 4,586,276

[45] Date of Patent: May 6, 1986

[54] APPARATUS FOR TRANSFERRING FLATWORK

[75] Inventor: Gerardus H. M. Kuipers, 's-Hertogenbosch, Netherlands

[73] Assignee: Amko International B.V., Kerkdriel, Netherlands

[21] Appl. No.: 729,618

[22] Filed: May 2, 1985

[30] Foreign Application Priority Data

May 4, 1984 [NL] Netherlands ..... 8401423

[51] Int. Cl.[4] ..... D06F 67/04

[52] U.S. Cl. ..... 38/8; 38/143; 271/198

[58] Field of Search ..... 271/204, 198; 38/143, 38/7, 8, 2; 198/473, 477, 680, 482, 465.3, 485.1, 465.4; 414/13

[56] References Cited

U.S. PATENT DOCUMENTS 3,198,315 8/1965 Long, Sr. .
3,205,548 9/1965 Sanders et al. ..... 38/143 X
4,411,082 10/1983 Ferrage ..... 38/2 X

FOREIGN PATENT DOCUMENTS 2751722 4/1979 Fed. Rep. of Germany ..... 38/8
2020365 7/1970 France .
1194188 6/1970 United Kingdom ..... 38/143

*Primary Examiner*—Werner H. Schroeder
*Assistant Examiner*—A. Falik
*Attorney, Agent, or Firm*—Murray Schaffer

[57] ABSTRACT

A transfer device for depositing flatwork on a continuously movable flat feed belt having a collector rod mounted to reciprocate in a substantially horizontal path to engage a surface of a vertically hung flatwork. An unrolling rod is mounted in association with the collector rod to move in an orbital path about the collector rod. Collector rod and unrolling rod are arranged to operate cyclically in a first collecting stage in which on engagement of the collector rod with the surface of the flatwork an edge of the flatwork is laid over the collecting rod and carried thereon and a second unrolling stage in which the unrolling rod passes about the collecting rod to engage the rear surface of the flatwork and in cooperation with the collecting rod lays the flatwork in stretched condition on the feed belt.

9 Claims, 5 Drawing Figures

APPARATUS FOR TRANSFERRING FLATWORK

BACKGROUND OF THE INVENTION

The present invention relates to apparatus for ironing laundry and in particular to a device for transferring flatwork or similar laundry to be ironed, from a spread vertical position, flat on the upper surface of a feed belt of a conveyor for feeding to a calender.

Depositing devices are known in many embodiments (see: FR No. A-2 020 365). A general problem found in the known depositing devices is that after the laundry is spread or stretched its leading end does not fall straight on the feed belt of the conveyor. In all the known depositing devices, it is necessary to correct the leading edge often. It also frequently happens that the corners of the laundry curl up, which leads to additional operations by which the laundry must be prevented from being treated incorrectly in the calender.

It is the object of the present invention to improve the above.

SUMMARY OF THE INVENTION

According to the present invention, apparatus is provided by which flatwork or similar laundry hanging from overhead clips is transferred and deposited on the upper surface of horizontally disposed feed belt for feeding directly to the ironing calender. The apparatus comprises an unrolling rod, mounted between two chains passing respectively over a pair of spaced sprocket wheels so that it moves in an orbital path into the hanging laundry in order to remove the laundry from the clips and spread it over the feed belt. In cooperation with the unrolling rod there is provided a substantially horizontally reciprocal collector rod, preferably having a rough surface. The collector rod is mounted on a pair of spaced chains in association with the unrolling rod, so that the unrolling rod, in its orbital movement also moves about the collector rod. The laundry is first placed on the collector rod and is then removed therefrom by the unrolling rod; the entire depositing cycle consisting first of a collector stage wherein the laundry is checked and stretched following by an unrolling stage which deposits the laundry fully and properly stretched on the feed belt.

The collector rod is rotatable about its axis and is provided with a selectively operable brake, arresting its rotation when it is in the vicinity of the vertically hung flatwork at the introduction to the horizontal upper surface part of the feed belt. The ends of the collector rod are arranged in slidable guides and are each connected, via an arm, with the links of one of its chains which are also entrained over the pairs of intermediate sprocket wheels. The collector rod initially contacts a face of the vertically hung flatwork adjacent its upper edge and this upper flap edge is laid over the collector rod. To prevent the laundry from falling off the collector rod, two aligned hold-down clips are arranged, between which the laundry hanging on the clamps can pass. A hold-down plate is arranged to force the flap edge of the laundry removed from the hanging clamps against the collector rod, so that during the entire collecting cycle the laundry is held down by the hold-down clips and the hold-down plate.

Furthermore, a wiper may be arranged underneath the hold-down plate so that the upper part of the laundry is smoothed on the unrolling rod once again.

Preferably, at least one of the sprocket wheels entraining the chains for both the collector rod and the rolling rod is fixed on a common shaft so that both chains move conjointly.

The invention will be further elucidated hereinafter on the basis of the drawings, in which the essence of the depositing device according to the invention will be indicated schematically.

DESCRIPTION OF THE INVENTION

Figure 5:
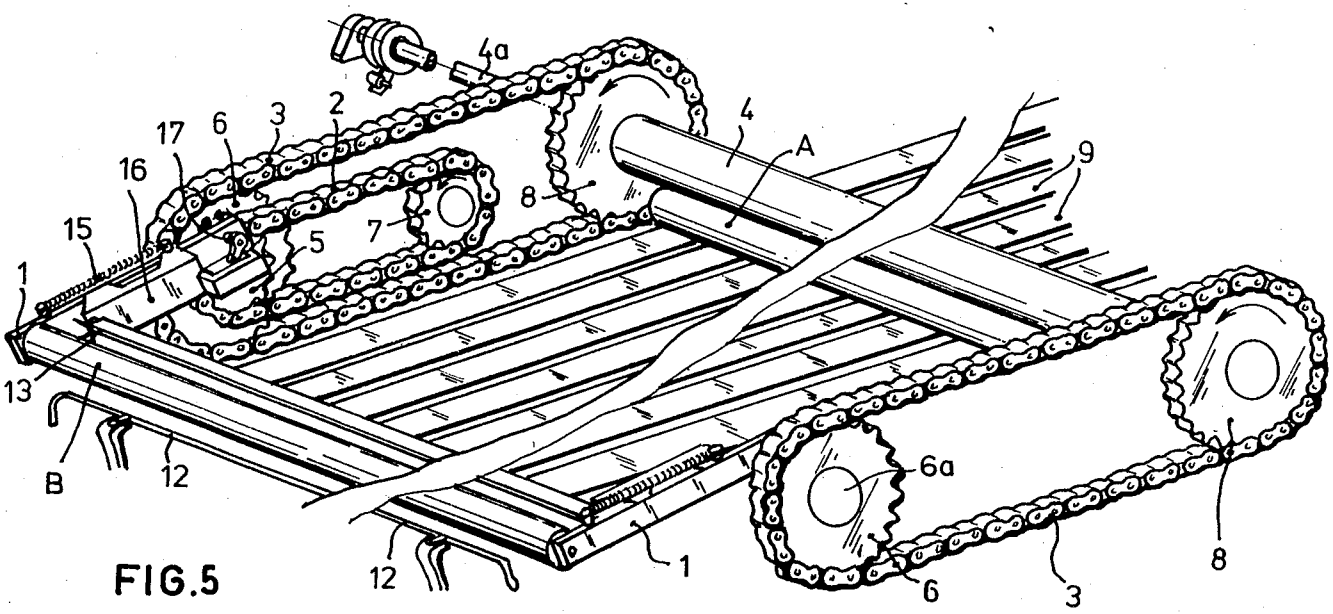
FIG. 5 is a perspective view of the depositing device in the position of FIG. 1.

As seen in FIG. 5, the mechanism includes a collector rod B and an unrolling rod A. The collector rod B is coated with a material with a very high coefficient of friction and has a length that is equal to the width of the largest laundry, exemplified in the following description as a sheet S, to be fed into it. The laundry, i.e. sheet S is presented to the apparatus being hung vertically by a plurality of clamps 10. Both ends of the collector rod B are journalled in arms 1 in a slidable guide by which the collector rod B can reciprocate substantially in the horizontal plane, toward and away from the vertically hung, i.e., perpendicularly to the vertically hanging sheet. The two extreme ends of the collector rod B are connected, via the two arms 1 (without any link between one at the left and one at the right) with the links of continuous drive chains 2 (only the one at the left is shown, in FIG. 5, the one at the right being omitted for clarity). The collector chains 2 extend over collector sprocket wheels 5 and 7, at least one of which is driven by conventional drive means.

The unrolling rod A which is longer than the collecting rod B is journalled at each end in corresponding links of a second chain 3 entrained over sprocket wheels 6 and 8. The two unrolling sprocket wheels 8 are connected by a fixed central axle 4 so that they rotate conjointly. The axle 4 is driven periodically by means of a selectively operable electromagnetic coupling **4*a* connected to the common motive means by which the feed belt 9, on which the laundry is to be laid is driven. Thus, the driving ability of the unrolling rod A is derived from and may be made to correspond to the speed of the feed belt 9 on which the sheet has to be laid. The left and the right side sprocket wheels 5 for the collector rod and the sprocket wheel 6 for the unrolling rod are interconnected fixedly by a common shaft 6*a*. Because of this the chains 2 and 3 have conjoint movement at a fixed linear speed ratio that is determined by the respective diameters of the unrolling and collector sprocket wheels 5 and 6. Preferably, the collector chains 2 are arranged to have the same speed V as that of the belt 9 while the speed of the unrolling chains 3** is somewhat higher, for instance 1.5 times as much so that the progress of the operating cycle takes place as later described.

The collector rod B is journalled at both ends in the respective left and right chains 3 in such a way that it can rotate about its center line. Rotation is, however, prevented by means of a selectively operated brake 11, when the rod B moves to the right, as seen in FIG. 1–4 and is allowed to freely rotate in the extreme left positions of the horizontal movement of the collector rod B.

It is efficient, especially for larger, and thereby heavier, sheets to make additional provisions, preventing the sheets from falling off the collector rod B despite the provision of the brake and the rough surface of the collector rod B. Such additional provisions may consist of half hold-down clips 12, shown schematically in FIG. 2, and shown more in detail in FIG. 5. These clips are spaced from each other in the central area of the depositing device in such a way that a sheet S, hanging on the the clamps 10 can pass and be clamped between the collecting rod B and the clips 12. After that the clamps 10 are moved away from each other, and a source of air under pressure O (FIG. 2) arranged in opposition to the collector rod B, provides a blast of air on the upper edge of the sheet so that simultaneously with the release of the sheet S from the clamps 10, the upper edge or flap of the sheet is blown over the collector rod B. The overhanging flap is then squeezed by a hold-down plate 13 that is slidably connected to the arms 1 via blocks 16 biased by springs 15 and an eccentric cam mechanism 17 (see FIG. 5), which is operated by rotation of the wheel 5.

A wiper 18 is arranged underneath the hold-down plate 13 so as to smooth the leading edge of the laundry once again when it passes the unrolling rod A (see FIG. 1).;

The hold-down plate 13 and the wiper 18 mounted thereon is forced against the collector rod B by the springs 15 and are released, opened at the right moment by the eccentric cam 17 to release the laundry for transfer on the collector rod B.

Figure 1:
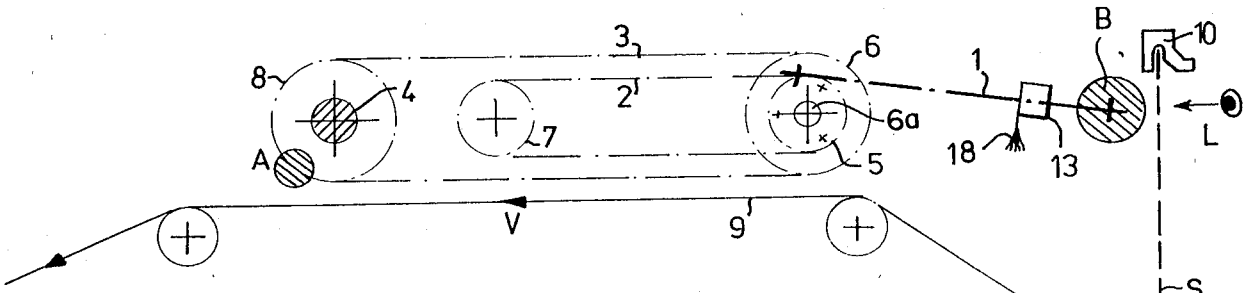
FIG. 1 is a schematic side view of the relevant components of the apparatus showing a sheet that has been spread and hung by clips.

The operation of the apparatus will be clear, following the sequence of FIGS. 1–4. The sheet S is hung from the clamps 10, spread in the neutral or introductory position across the entrance into the transfer device, so that the leading side is straight (FIG. 1). This condition is sensed with the aid of a photocell L, the output of the which activates the electromagnetic coupling 4*a* by which the axle 4 is coupled to the drive for belts 9 and itself made to be driven. Rotation of the axle 4 causes the chains 2 and 3 to be conjointly orbited about their respective sprocket wheels carrying the rods A and B with them, in the direction of the arrows. The collector rod B moves in a substantially horizontal path to the right and forces itself into the face of the sheet. When the collector rod B is in the extreme right position (FIG. 2) the clamps 10 open and the sheet drops over the collector rod B being simultaneously aided by a blast of air from the pressurized source O. In lieu of an air blast, a plate or similar movable instrument may be used to position the flap. Simultaneously, the brake 11 has been applied against the collector rod B so that rod B cannot rotate. Because the collector rod B is coated with a material that has a very high coefficient of friction, the sheet will not normally fall back.

Figure 2:
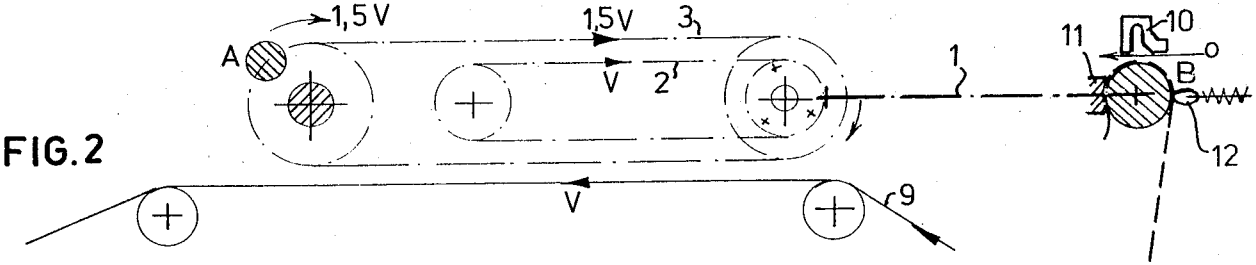
FIG. 2 is a similar view as FIG. 1 but with the sheet passed over the collector rod; the hold-down plate being completely open and the sheet clamped between the hold-down clip and the collector rod.

Prior to the release of the sheet S from the clamp 10 and during the time the sheet is blown over onto the collector rod B, the sheet is held the collector rod B by the resilient hold-down clips 12 which are pressed against the sheet (FIG. 2). Immediately, after the sheet has been placed on the collector rod B, it is squeezed over its full width, on the rear side of the collector rod B, by the hold-down plate 13, which is moved forwardly into the sheet (FIG. 2).

Figure 3:
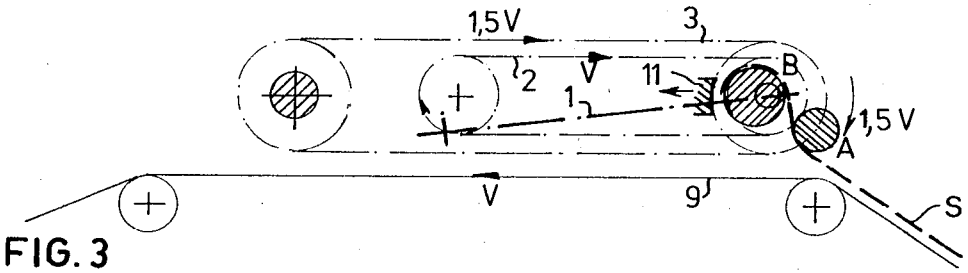
FIG. 3 is a view similar to FIG. 1 and FIG. 2 but with the unrolling rod behind the sheet, in which position the hold-down plate forces the upper side of the laundry against the collector rod and in which the unrolling rod pulls the upper side out because the collector rod turns.
Figure 4:
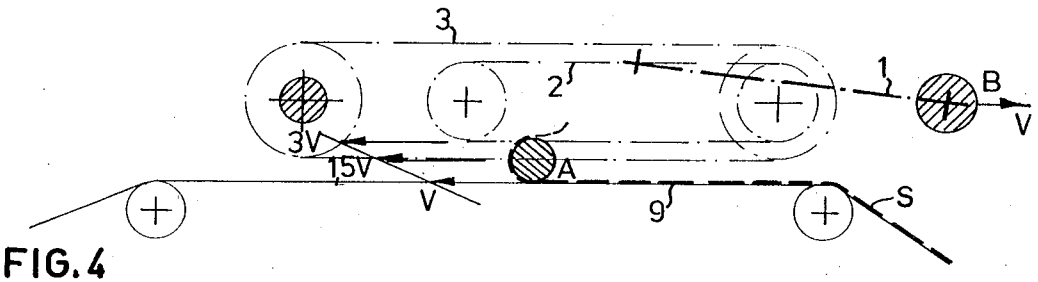
FIG. 4 is yet a similar view as the preceding figures but with the sheet on the feed belt, in which position the unrolling rod has passed underneath the wiper and unrolls the stretched upper side of the laundry on the feed belt.

After this the continued travel of the chains 2 and 3 causes the collector rod B to move to the left (FIG. 3) where at a selected point, the brake 11 is released after which the collector rod B can rotate. Meanwhile, because the speed of travel of the unrolling rod A is greater than that of the collector rod B, the unrolling rod A moving in an orbital path, simultaneously arrives behind the sheet S (FIG. 3). The sheet is thus carried toward the rear end of the apparatus draped over the collector rod B and being pushed by the unrolling rod A onto the feed belt 9. During this movement, the collector rod B is freely rotatable about its central axis, so that as the unrolling rod A overtakes it, the flap end of the sheet S falls on the rod B onto the rod A(FIG. 4). At the end of their travel along the lower run of the chain 2, the unrolling rod continues to move to the left being carried by chains 3 while the collector rod B releases itself and goes to the right again, i.e., back to its initial start position. As soon as a sufficient amount of the sheet is deposited on the feed belt 9, it creates a small drag on the unrolling rod A, so that as the rod A is carried about by the chain 3, it stretches the sheet on the belt 9 and begins to rotate, counter clockwise (FIG. 4), rolling the flap end of the sheet smoothly on the feed belt 9.

A wiper 18, mounted underneath the hold-down plate 13, smooths the upper side of the laundry on the unrolling rod A when the unrolling rod A, passes beneath the wiper 18.

Because of this it is not only possible to keep the leading side of the sheet correctly after being spread, but the corners and the leading side of the sheet are also laid down flat onto the feed belt.

I claim:

1. Apparatus for depositing spread vertically hung flatwork or similar laundry articles on a continuously movable flat feed belt for conveyance to an ironing calender, comprising a collector rod and an unrolling rod, said collector rod being mounted to reciprocate in a substantially horizontal path to engage a surface of said vertically hung flatwork, said unrolling rod being mounted to move in an orbital path about said collector rod, said collector rod and unrolling rod being arranged for cyclical operation comprising a collecting stage in which on engagement of said collector rod with the surface of said flatwork an edge of said flatwork is laid over said collecting rod and carried thereon, and an unrolling stage in which said unrolling rod passes about said collecting rod to engage the rear surface of said flatwork and in cooperation with said collecting rod lays said flatwork in stretched condition on said feed belt as said collector and unrolling rods disengage from contact with said flatwork.

2. The apparatus according to claim 1 wherein said collector rod is formed with a high friction surface.

3. The apparatus according to claim 1 wherein said collector rod is freely rotatable about its central axis and is provided with brake means for arresting rotation during said collecting stage said collector rod being free of said brake during said unrolling stage.

4. The apparatus according to claim 3 wherein said collector rod is journalled at each of its ends in an arm, each of said arms being journalled in a link respectively in one of a pair of first spaced endless chains.

5. The apparatus according to claim 4, wherein said unrolling rod is journalled at each of its ends in a link in a respective one of a pair of second spaced endless chains entrained about a pair of spaced sprocket wheels and extending parallel to the respective one of said first chains on which said collector rod is journalled, one of said sprocket wheels about which each of said second pair of chains are entrained being driven, the other of said sprocket wheels being fixedly connected for conjoint rotation to a respective one of said sprocket wheels by which said first chains on which said collector rod is journalled, the length of said first and second pair of chains being such that said second pairs of chains travels further than said first pair of chains in a single operating cycle.

6. The apparatus according to claim 4 including brush means to smooth the upper surface of said flatwork as it is unrolled on said feed belt.

7. The apparatus according to claim 5 wherein said unrolling rod travels at a higher speed than said collector rod.

8. The apparatus according to claim 1 including clip means engaging the rear surface of said flatwork against the collector rod and a plate for holding the edge of said flatwork laid over said collector rod during said collecting stage.

9. The apparatus according to claim 1, include means for applying a blast of air under pressure against the edge of said flatwork as it is laid over said collector rod.

* * * * *